US009373913B2

(12) United States Patent
Noda et al.

(10) Patent No.: US 9,373,913 B2
(45) Date of Patent: Jun. 21, 2016

(54) LEVER TYPE CONNECTOR

(71) Applicant: SUMITOMO WIRING SYSTEMS, LTD., Yokkaichi, Mie (JP)

(72) Inventors: Masahiro Noda, Yokkaichi (JP); Ryotaro Ishikawa, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 65 days.

(21) Appl. No.: 14/061,162

(22) Filed: Oct. 23, 2013

(65) Prior Publication Data

US 2014/0134861 A1 May 15, 2014

(30) Foreign Application Priority Data

Nov. 15, 2012 (JP) ..... 2012-251179

(51) Int. Cl.
*H01R 12/88* (2011.01)
*H01R 13/629* (2006.01)

(52) U.S. Cl.
CPC ..... *H01R 13/62938* (2013.01)

(58) Field of Classification Search
CPC ..... H01R 13/62938; H01R 13/62933; H01R 13/62955; H01R 13/62977; H01R 12/88; H01R 13/629
USPC ..... 439/157
See application file for complete search history.

(56) References Cited

U.S. PATENT DOCUMENTS 5,230,635 A * 7/1993 Takenouchi et al. ..... 439/157
5,595,492 A * 1/1997 Taguchi ..... H01R 13/62955 439/157
6,623,285 B2 9/2003 Nishide
2002/0173185 A1* 11/2002 Fukushima ..... H01R 13/641 439/157
2008/0064242 A1* 3/2008 Shishikura et al. ..... 439/157
2008/0102666 A1* 5/2008 Yamashita ..... H01R 13/62938 439/157
2008/0119074 A1* 5/2008 Okano ..... 439/140
2008/0248664 A1 10/2008 Shibata
2009/0263997 A1* 10/2009 Tonosaki ..... H01R 13/62944 439/157
2012/0289070 A1* 11/2012 Uchida ..... H01R 13/62955 439/157
2013/0237078 A1* 9/2013 Ikeda ..... H01H 9/102 439/157
2014/0248788 A1* 9/2014 Kodama ..... H01R 13/62938 439/310

* cited by examiner

*Primary Examiner* — Truc Nguyen
(74) *Attorney, Agent, or Firm* — Oliff PLC

(57) ABSTRACT

A lever type connector includes: a first housing; a lever that is rotatably fixed to the first housing; a cam groove formed in the lever; and a second housing having a cam follower. The first housing and the second housing are fitted together by rotating the lever 30 in a fitting direction in a state in which the cam groove and the cam follower are engaged to each other. A plurality of operation protrusions (fitting operating portions) are formed on the lever so as to contact an operator's finger at the time of a fitting operation, and are arranged at an interval in the rotating direction of the lever.

13 Claims, 9 Drawing Sheets

LEVER TYPE CONNECTOR

BACKGROUND

Some embodiments relate to a lever type connector.

Japanese Patent No. 3743555 discloses a lever type connector that includes: (i) a first housing, (ii) a lever that is rotatably fixed to the first housing, and on which a cam groove is formed, and (iii) a second housing having a cam follower. The first and second housings are fitted together or separated from each other by rotating the lever while the cam groove and the cam follower are engaged to each other.

SUMMARY

In the above related art lever type connector, when the lever is rotatingly operated, an operator's finger is hooked to an operating portion formed on the lever, and the finger and the lever are rotatingly moved together. Because of this configuration, if insufficient space exists around the lever type connector for rotatingly moving the operator's finger, it may be problematic to rotate and operate the lever.

Some embodiments address the above issue and thereby enhance operatability.

One such embodiment is a lever type connector that includes: (i) a first housing, (ii) a lever rotatably fixed to the first housing, (iii) a cam groove formed on the lever, and (iv) a second housing having a cam follower. The first and second housings are fitted to each other by rotating the lever in a fitting direction in a state in which the cam groove and the cam follower are engaged to each other. A plurality of fitting operation portions are also provided and formed on the lever so as to contact an operator's finger at the time of the fitting operation, the fitting operation portions being arranged at an interval in a direction in which the lever is rotated.

In accordance with this embodiment, if both housings are fitted together, the lever can be rotated in a fitting direction while the plurality of fitting operation portions are passed from one hand to the other in order. If one fitting operation portion is rotatingly operated, the angle through which an operator's hand rotates is small, such that even though insufficient space is provided for rotating a hand in the area around the lever type connector, the lever rotation can be operated without any or reduced problems, and operatability is enhanced or excellent.

DETAILED DESCRIPTION OF THE EMBODIMENTS

Figure 1:
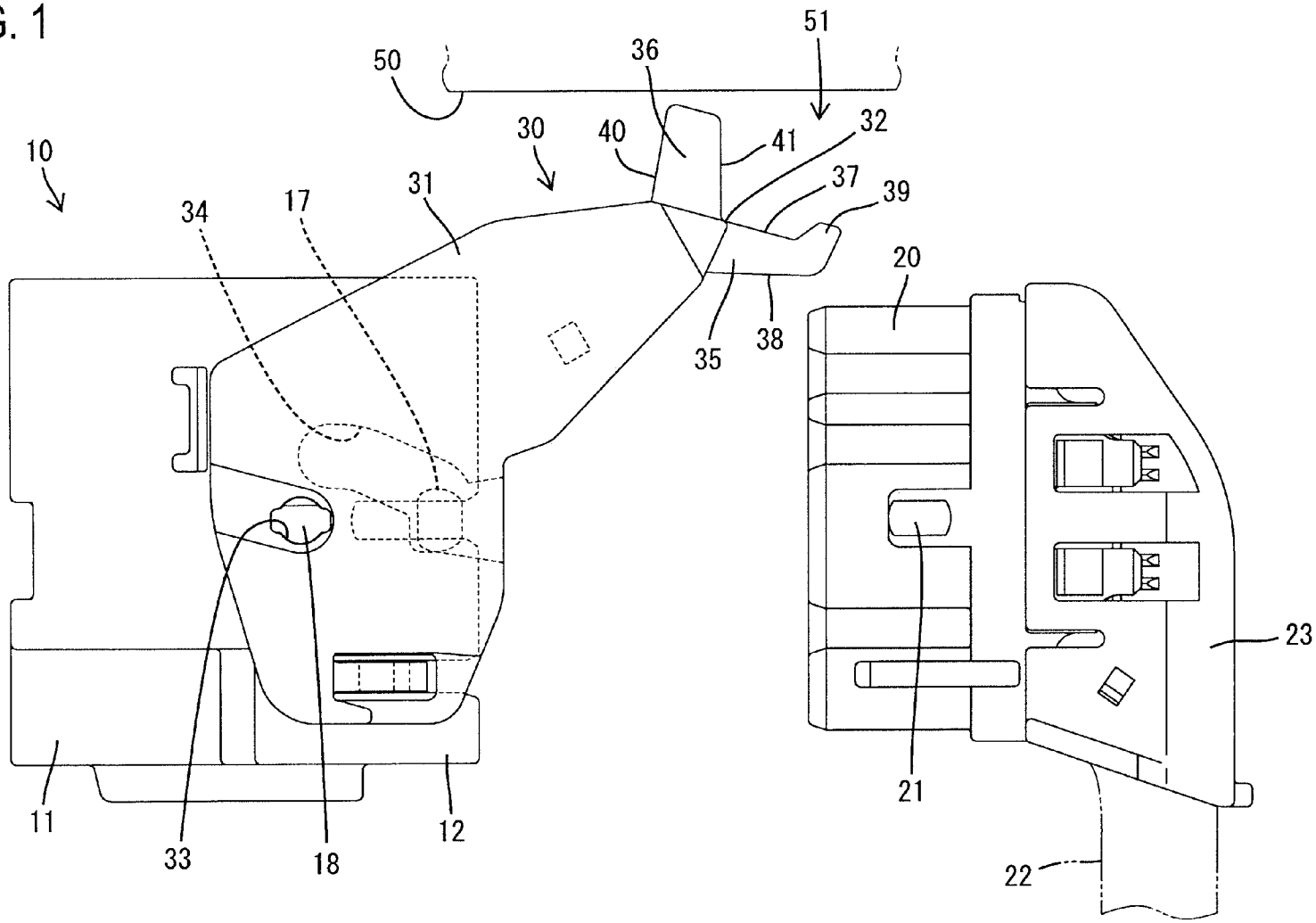
FIG. 1 is a side view showing a state before first and second housings are fitted together and a state in which the first and second housings are separated from each other in accordance with a first embodiment.

In accordance with a lever type connector of a first embodiment, if the cam groove and the cam follower are engaged to each other, then the first and second housings can be separated from each other by rotating the lever in a removal direction opposite to the fitting direction.

A plurality of separating operation portions (corresponding to first and second operation protrusions of the first embodiment can also be provided that are formed on the lever so as to contact an operator's finger at the time of a separating operation and are arranged at an interval in a direction in which the lever is rotated.

According to this structure, if the two housings are separated from each other, the lever can be rotated in a separation direction by passing the plurality of separating operation portions from one hand to the other in order. If one separating operation portion is rotatingly operated, the angle through which an operator's hand rotates is small, such that even though insufficient space is provided around the lever type connector for rotating a hand in the surroundings, the lever rotation can be operated without any or with reduced problems, and operatability is enhanced or excellent.

A lever type connector in accordance with a second embodiment includes a pair of arm portions, which constitute the lever, and in which the cam grooves are formed, and which are arranged along an outside surface of the first housing; and a connecting portion that constitutes the lever and connects the pair of arm portions.

At least one of the plurality of fitting operation portions may protrude from the connecting portion in a cantilevered state and may extend along a width direction connecting the pair of arm portions.

According to this structure, the connecting portion is reinforced by fitting operating portions, so improper deformation is not generated or reduced in the pair of arm portions. Thus, instability of engagement of the cam grooves and the cam followers due to the improper deformation of the arm portion can be reduced or suppressed.

A lever type connector of a third embodiment includes a pair of arm portions, which constitute the lever, which have the cam grooves formed therein, and which are arranged along an outside surface of the first housing; and a connecting portion that constitutes the lever and connects the pair of arm portions.

The plurality of fitting operation portions protrude from the connecting portion in a cantilevered state in different directions from each other, and the protrusion directions of the plurality of fitting operation portions can be directions diagonal to the rotating direction.

According to this structure, only one connecting portion is needed to connect a pair of arm portions, such that the connecting portion does not interfere with electric wires or the like that extend from the housings if the lever is rotated. Additionally, the protrusion directions of the plurality of fitting operation portions are directions diagonal to the rotating direction, such that all of the fitting operation portions sufficiently function to facilitate rotation of the lever.

In accordance with a lever type connector of a fourth embodiment, when the fitting operation portion receives a pressing force in the rotating direction by an operator's finger at the time of the fitting operation, the fitting operation portion protrudes in a direction such that the pressing force is away from the rotation center of the lever. In the fitting operation portion, a finger hook protrusion may be formed, which protrudes in a direction substantially perpendicular to a direction in which the lever is rotated.

According to this structure, by hooking a finger to the finger hook protrusion, the lever can be reliably rotated in the fitting direction. By arranging a finger hook protrusion in the fitting operation portion, design restrictions at the time of designing the direction in which the fitting operation portion protrudes can be alleviated.

Embodiment 1

The first embodiment is discussed below with reference to FIGS. 1-9. As shown in FIGS. 1-4, the lever type connector of this embodiment is provided with a first housing 10, a second housing 20, an electric wire cover 23, and a lever 30.

Figure 5:
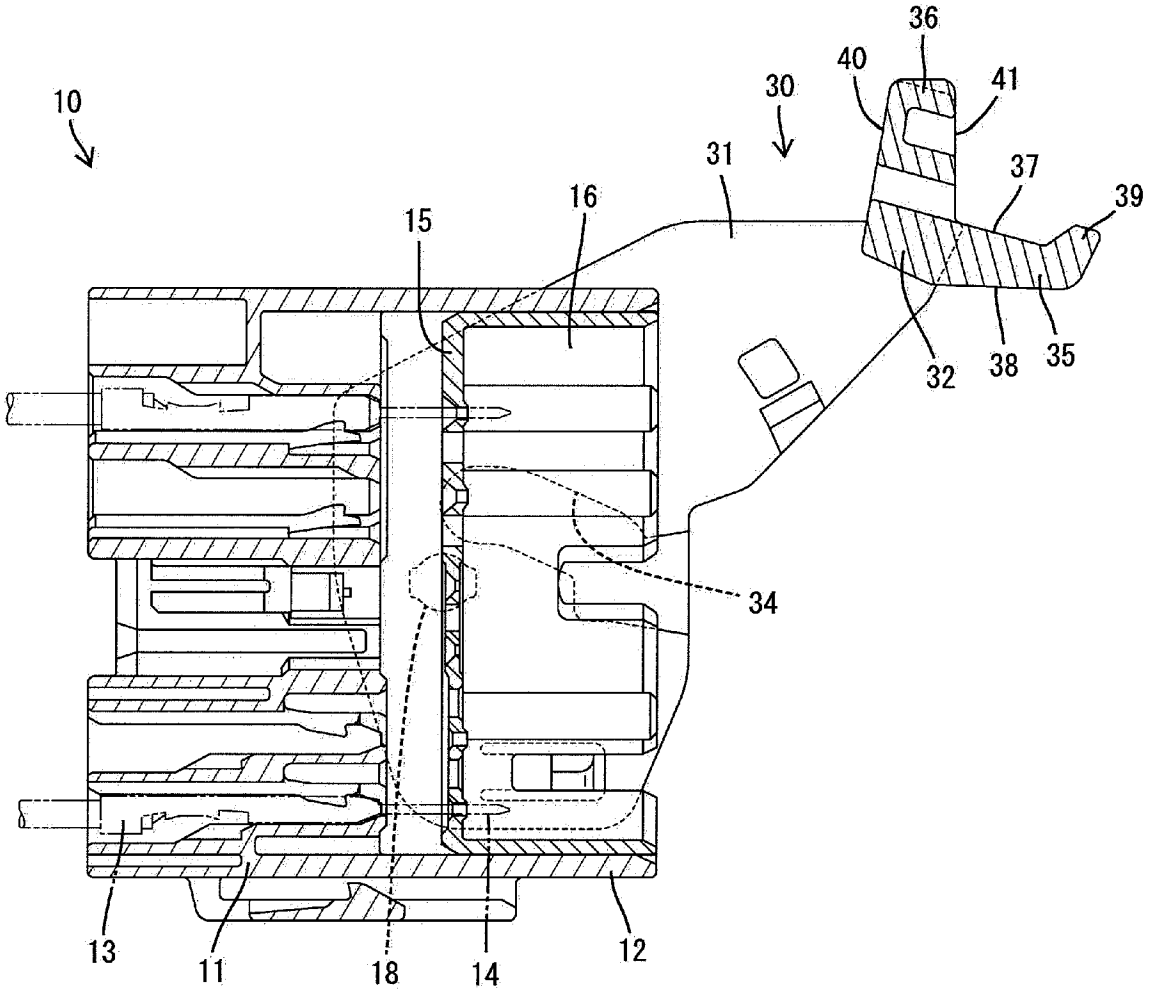
FIG. 5 is a cross-sectional view of the first housing showing a state in which a lever is at an initial position.
Figure 6:
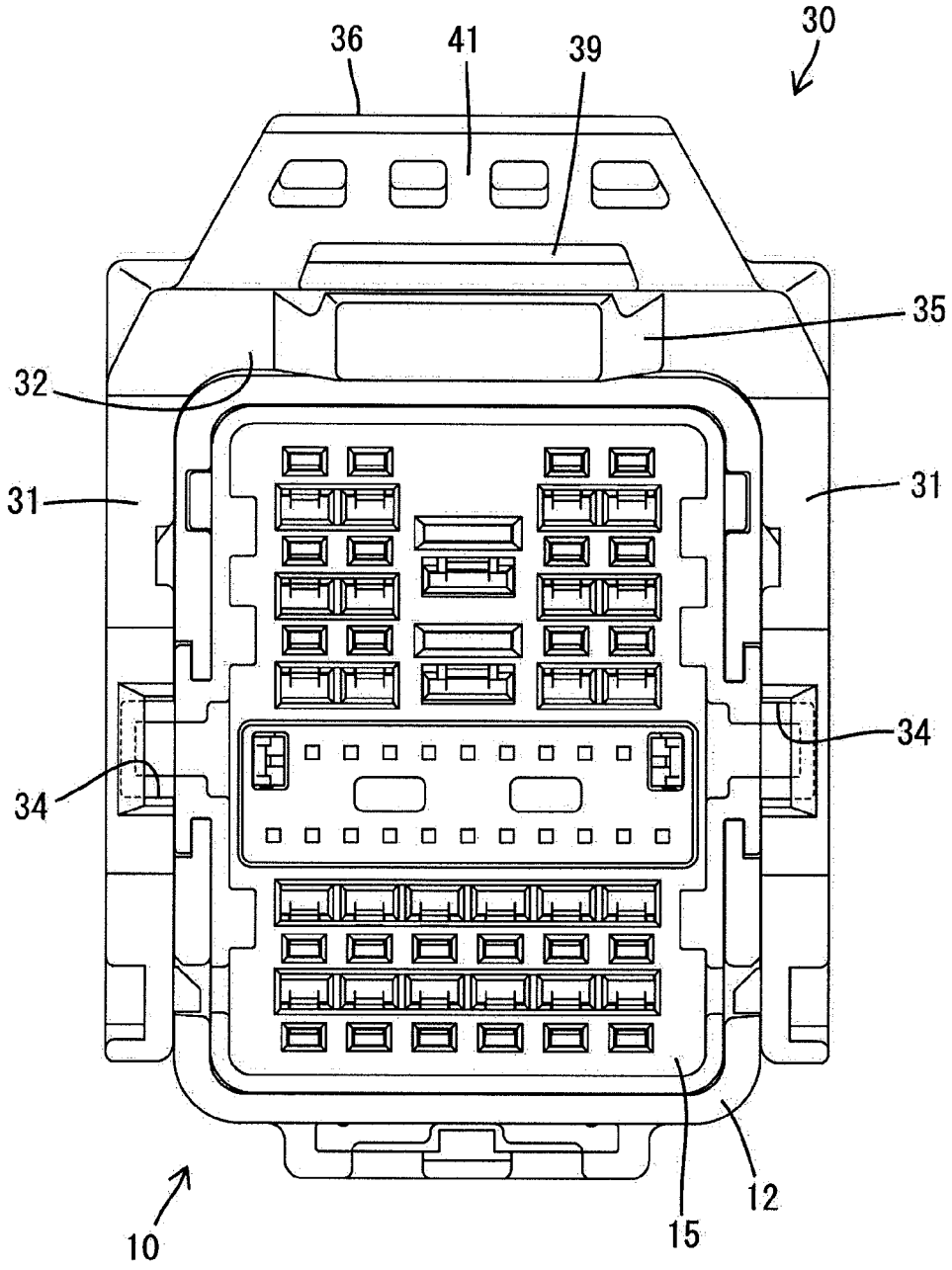
FIG. 6 is a front view of the first housing showing a state in which the lever is at an initial position.
Figure 8:
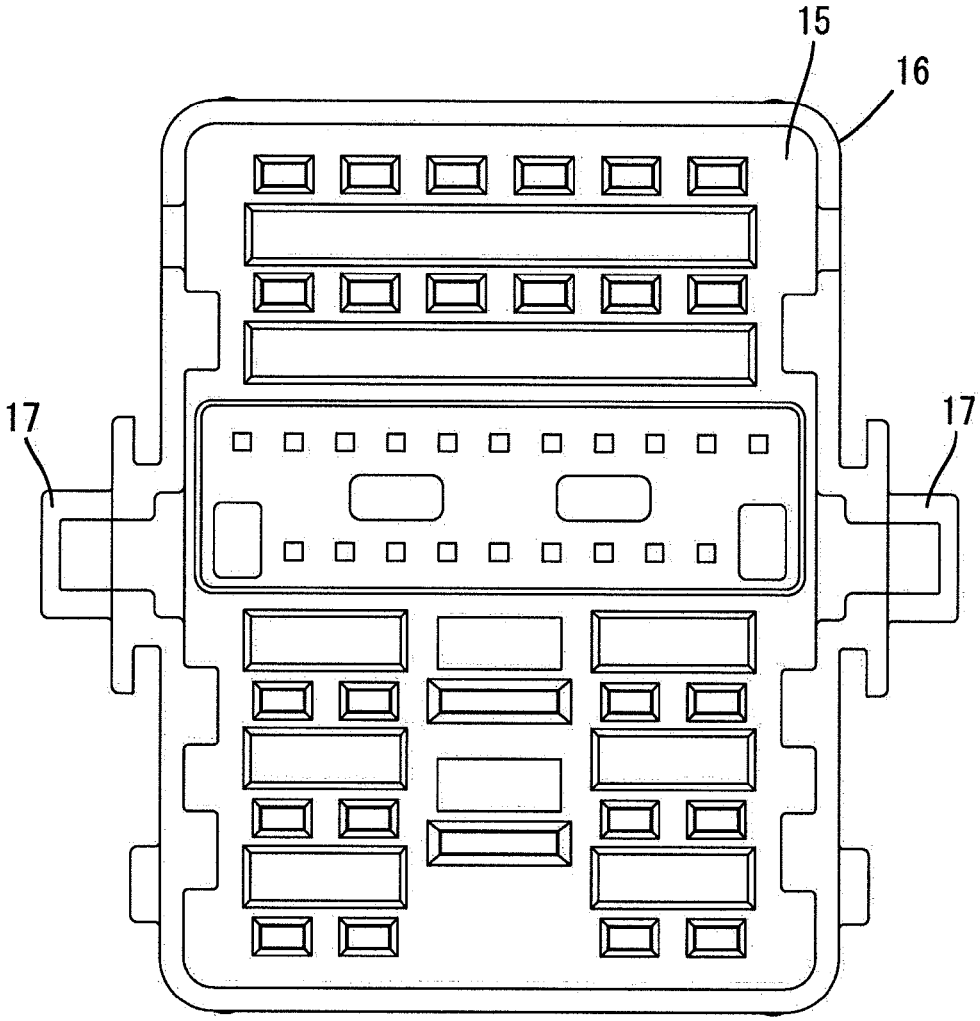
FIG. 8 is a front view of a moving plate.
Figure 9:
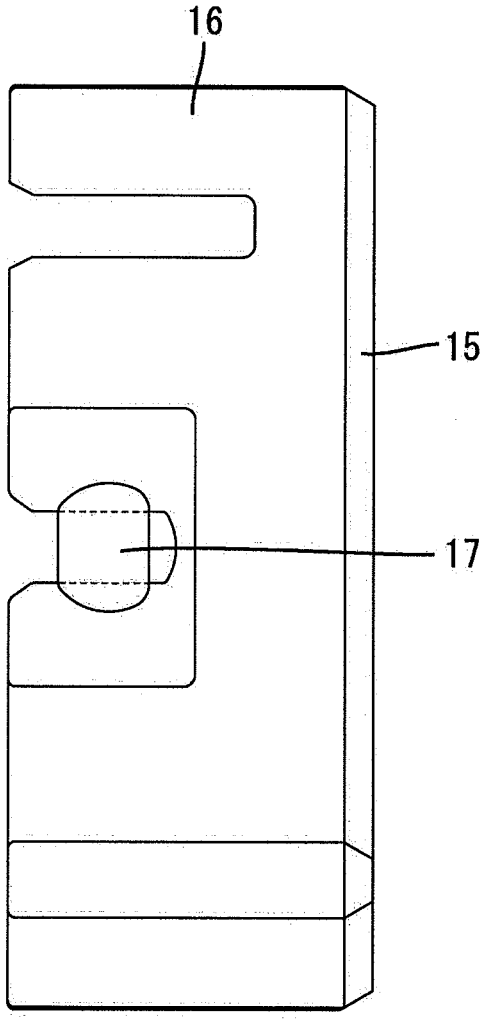
FIG. 9 is a side view of the moving plate.

FIG. 5 shows a related art version of the first housing 10 in which a squarely tubular hood portion 12 protrudes to a front side (right side of FIG. 5) from a terminal housing portion 11. A plurality of male terminal fittings 13 are fixed to the first housing 10, and the hood portion 12 surrounds tabs 14 of tip ends of the male terminal fittings 13. A bundle of electric wires (not shown) connected to the plurality of male terminal fittings 13 extends from a rear surface of the first housing 10 (terminal housing portion 11). A moving plate 15 is movably housed in the hood portion 12. FIG. 5 shows a related art version of the moving plate 15 for positioning the plurality of tabs 14 surrounded by the hood portion 12. As shown in FIGS. 8 and 9, in a peripheral wall portion 16 that constitutes the moving plate 15, a pair of cam protrusions 17 are formed, one at the left and one at the right. As shown in FIG. 1, on the outside surface of the right and left side wall portions that constitute the hood portion 12, a pair of support shafts 18, one at the left and one at the right, are protrudingly formed in a coaxial state.

As shown in FIG. 1, the second housing 20 forms a block shape. A plurality of related art female terminal fittings (not shown) are housed in the second housing 20. On the right and left outside surfaces of the second housing 20, a pair of cam followers 21 are protrudingly formed. The pair of cam followers 21 fit into the cam protrusions 17 of the moving plate 15 and are engaged to cam grooves 34 of the lever 30. As shown in FIG. 1, a bundle of the electric wires 22 connected to the plurality of male terminal fittings extends from the rear surface of the second housing 20. An electric wire cover 23 is assembled to the second housing 20 so as to cover the rear surface. Inside of the electric wire cover 23, the direction of the bundle of the electric wires 22 extending from the second housing 20 is changed to a substantially perpendicular angle. The bundle of the electric wires 22 extends to the outside of the electric wire cover 23 in a direction substantially parallel to the rear surface of the second housing 20.

Figure 7:
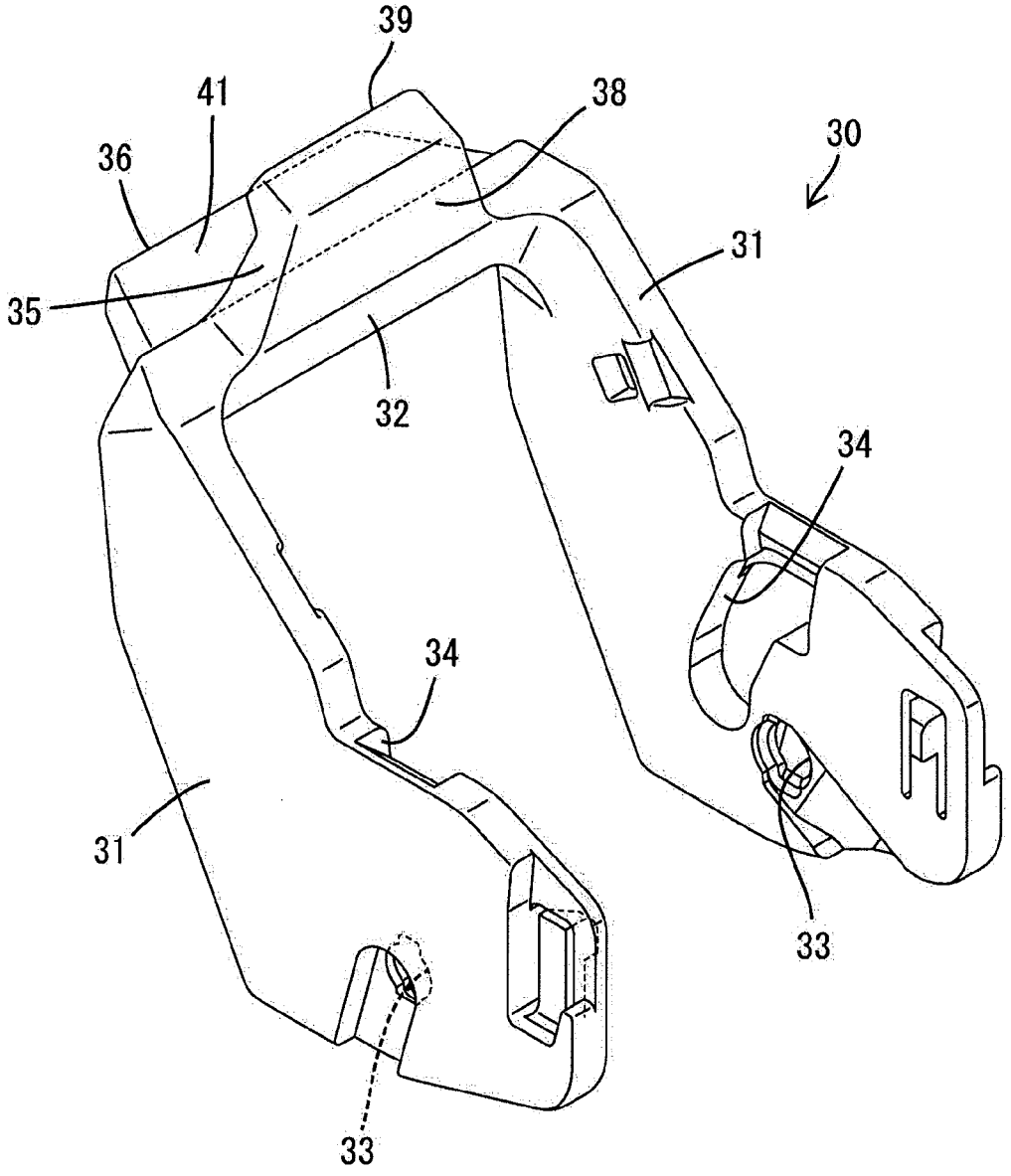
FIG. 7 is a perspective view of the lever.

The lever 30 is formed of synthetic resin. As shown in FIG. 7, the lever 30 is integrally formed with a pair of arm portions 31, one at the left and one at the right, that have a plate shape, and a connecting portion 32 that bridges a portion of the outer peripheries of the two arm portions 31. As shown in FIG. 1, in the lever 30, bearing holes 33 formed in the arm portions 31 are fit onto the support shafts 18, so the lever is attached so as to be rotated between an initial position (see FIGS. 1, 2, and 5) and a fitting position (see FIG. 4) with respect to the first housing 10. While the lever 30 is being rotated between the initial position and the fitting position, the arm portions 31 are kept at a position along the right and left outside surfaces of the first housing 10 (that is, in a state in which they approach and face the right and left outside surfaces of the first housing 10). Inside of the arm portions 31 (the surface facing the outside surface of the first housing 10), the cam grooves 34 are formed extending so as to surround the bearing holes 33 (the rotation center of the lever 30) of the arm portions 31.

Figure 2:
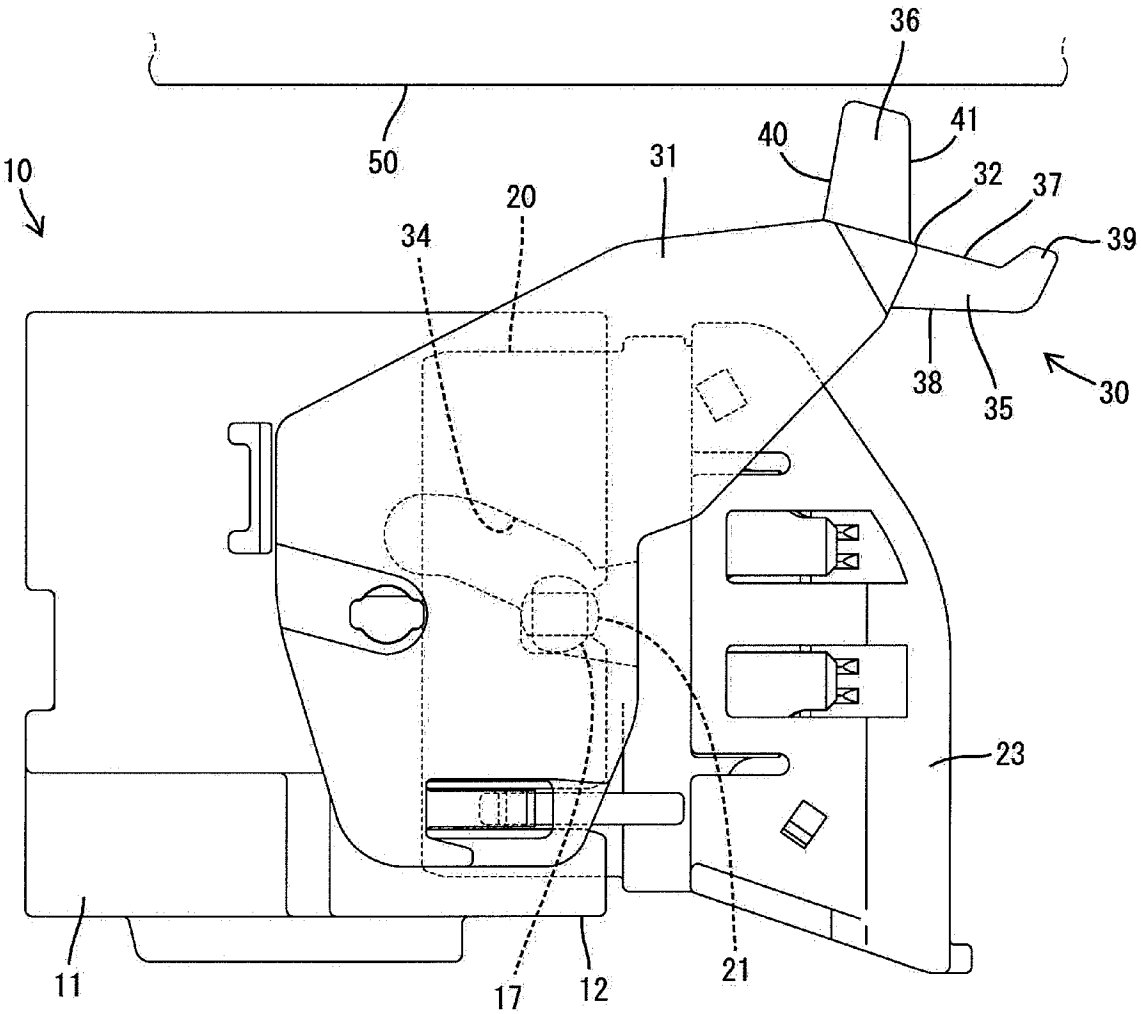
FIG. 2 is a side view showing a state in which the first and second housings are shallowly fitted together.
Figure 4:
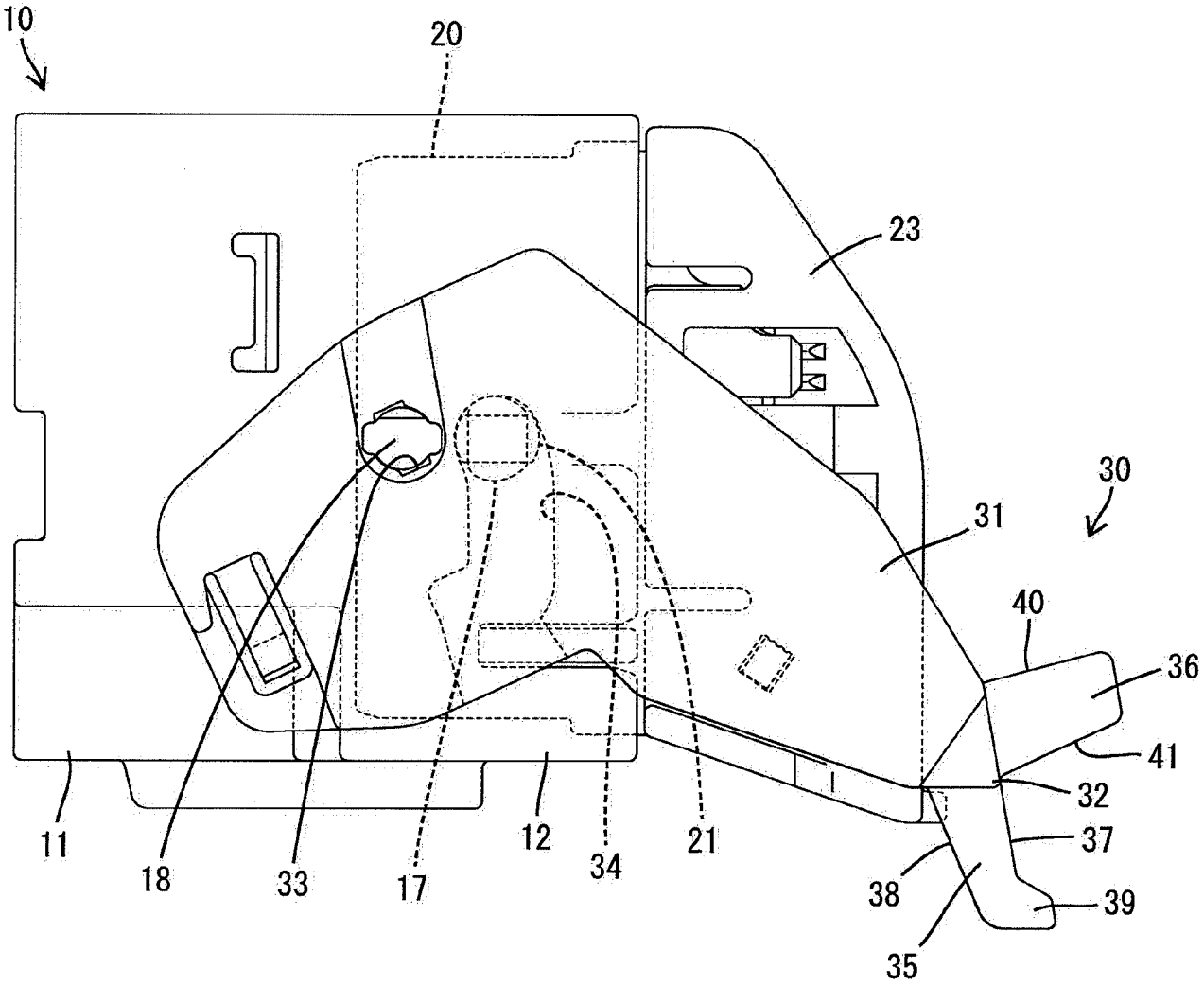
FIG. 4 is a side view showing a state in which the first and second housings are fitted together.

As shown in FIG. 1, when the first housing 10 and the second housing 20 are fitted together, the lever 30 is held at the initial position. From this state, as shown in FIG. 2, the second housing 20 is shallowly fitted into the inside of the hood portion 12 of the first housing 10, and the pair of cam followers 21 are made to advance to entrances of the cam grooves 34. Next, from this state, the lever 30 is rotated on the fitting position side. As the lever 30 is rotated, due to a cam operation (force-multiplying action) by the engagement of the cam grooves 34 and the cam followers 21, the first housing 10 and the second housing 20 are brought together, and fitting proceeds. Additionally, as shown in FIG. 4, when the lever 30 reaches the fitting position, the first housing 10 and the second housing 20 will be in a normal fitting state.

If the first housing 10 and the second housing 20 that are fitted together are separated from each other, the lever 30 at the fitting position is rotated to the initial position side. As the lever 30 is rotated, due to a cam operation (force-multiplying action) by the engagement of the cam grooves 34 and the cam followers 21, the first housing 10 and the second housing 20 are gradually separated from each other. Furthermore, as shown in FIG. 2, after the lever 30 reaches the initial position, if the first housing 10 and the second housing 20 are grasped by hand and pulled apart, as shown in FIG. 1, then the first housing 10 and the second housing 20 are separated from each other.

In accordance with the connecting portion 32 (as shown in FIGS. 1 and 7), (i) the structure that performs a fitting operation on the lever 30 (rotates the lever 30 from the initial position to the fitting position) and (ii) a first operation protrusion 35 (fitting operation portion that is a structural element of this embodiment) that is also used as the structure that performs a separating operation on the lever 30 (rotates the lever 30 from the fitting position to the initial position), are formed so as to be integrally rotatable with the lever 30. In the same manner, on the lever 30, a second operation protrusion 36 (fitting operation portion that is a structural element of this embodiment) that is also used as the structure for performing the fitting operation and the separating operation of the lever 30, as is the first operation protrusion 35, is formed so as to be integrally rotatable with the lever 30.

The first operation protrusion 35 extends in a plate shape in a width direction (a direction connecting the pair of arm portions 31, that is, a direction parallel to a direction of a length of the connecting portion 32) and protrudes from the connecting portion 32. The protruding direction of the first operation protrusion 35 is a direction away from the bearing hole 33 and is a direction diagonal to both: (i) a rotational displacement direction of the lever 30 (hereafter referred to as a "fitting direction") during fitting, and (ii) a diameter direction centered on the bearing hole 33 (hereafter referred to as a "diameter direction"). The protruding end portion of the first operation protrusion 35 is positioned forward, in the fitting direction, of the base end portion (portion at which the first operation protrusion 35 is connected to the connecting portion 32).

The first operation protrusion 35 is provided with two operating surfaces 37 and 38 that are in a back-to-back positional relationship with respect to the direction in which the lever 30 is rotated. Of the two operating surfaces 37 and 38, the one at the rear side in the fitting direction is the first operating surface 37, used for fitting, which an operator's finger contacts when an operation in which the lever is rotated in the fitting direction is performed. Of the two operating surfaces 37 and 38, the one at the rear side (that is, the front side in the fitting direction) in the rotational displacement direction of the lever 30 when the first housing 10 and the second housing 20 are separated from each other (hereafter referred to as a "separation direction") is the second operating surface 38, used for separation, which an operator's finger contacts when the lever 30 is rotated in a separation direction.

When a pressing force in the fitting direction by an operator's finger is received at the time of the fitting operation, the first operating surface 37, used for fitting, is inclined in a direction such that the pressing force is guided to a protruding end side of the first operation protrusion 35 (direction away from the bearing hole 33). Because of this, if a finger presses down the first operating surface 37, used for fitting, in the fitting direction, there is a concern that the finger may slip from the protruding end of the first operation protrusion 35. As a countermeasure against this, at the protruding end peripheral portion of the first operating surface 37 for fitting, a finger hook protrusion 39 is formed, which protrudes outward in the diameter direction.

In the same manner as the first operation protrusion 35, the second operation protrusion 36 extends in a plate shape in a width direction and protrudes from the connecting portion 32. The protruding direction of the second operation protrusion 36 is a direction away from the bearing hole 33 and is a direction diagonal to both the fitting and diameter directions. The protruding end portion of the second operation protrusion 36 is positioned rearward, in the fitting direction, of the base end portion (portion at which the second operation protrusion 36 is connected to the connecting portion 32). The base end portions of the second operation protrusion 36 and the first operation protrusion 35 are adjacent to each other. The second operation protrusion 36 at a position that is separated rearward, in the fitting direction, of the first operation protrusion 35. The angle formed by the first operation protrusion 35 and the second operation protrusion 36 substantially about the connecting portion 32 is approximately 120°.

The second operation protrusion 36 is provided with two operating surfaces 40 and 41 that are in a back-to-back positional relationship with respect to the direction in which the lever 30 is rotated. Of the two operating surfaces 40 and 41, the one at the rear side, in the fitting direction, is the second operating surface 40, used for fitting, which an operator's finger contacts when the lever 30 is rotated in the fitting direction. The second operating surface 40, used for fitting is positioned rearward, in the fitting direction, of the first operating surface 37, used for fitting. Of the two operating surfaces 40 and 41, the one at the rear side, in the separation direction, is the first operating surface 41, used for separation, which an operator's finger contacts when the lever 30 is rotated in the separation direction. The first operating surface 41, used for separation, is positioned forward, in the separation direction, of the second operating surface 38, used for separation.

If the first housing 10 and the second housing 20 are fitted together, even if a work space needed for rotating the hand to rotatingly operate the lever 30 cannot be secured, according to the lever type connector of this embodiment, an operation can be easily performed. FIG. 1 shows a specific restriction mode of a work space. In a state in which the lever 30 is at the initial position, another member 50 is arranged in the vicinity of the connecting portion 32, so it is difficult to hook a finger to the second operation protrusion 36. However, a work space 51 into which a finger can be inserted is secured between the first operation protrusion 35 and the other member 50. Thus, the initial stage of the fitting operation uses this first operation protrusion 35.

Figure 3:
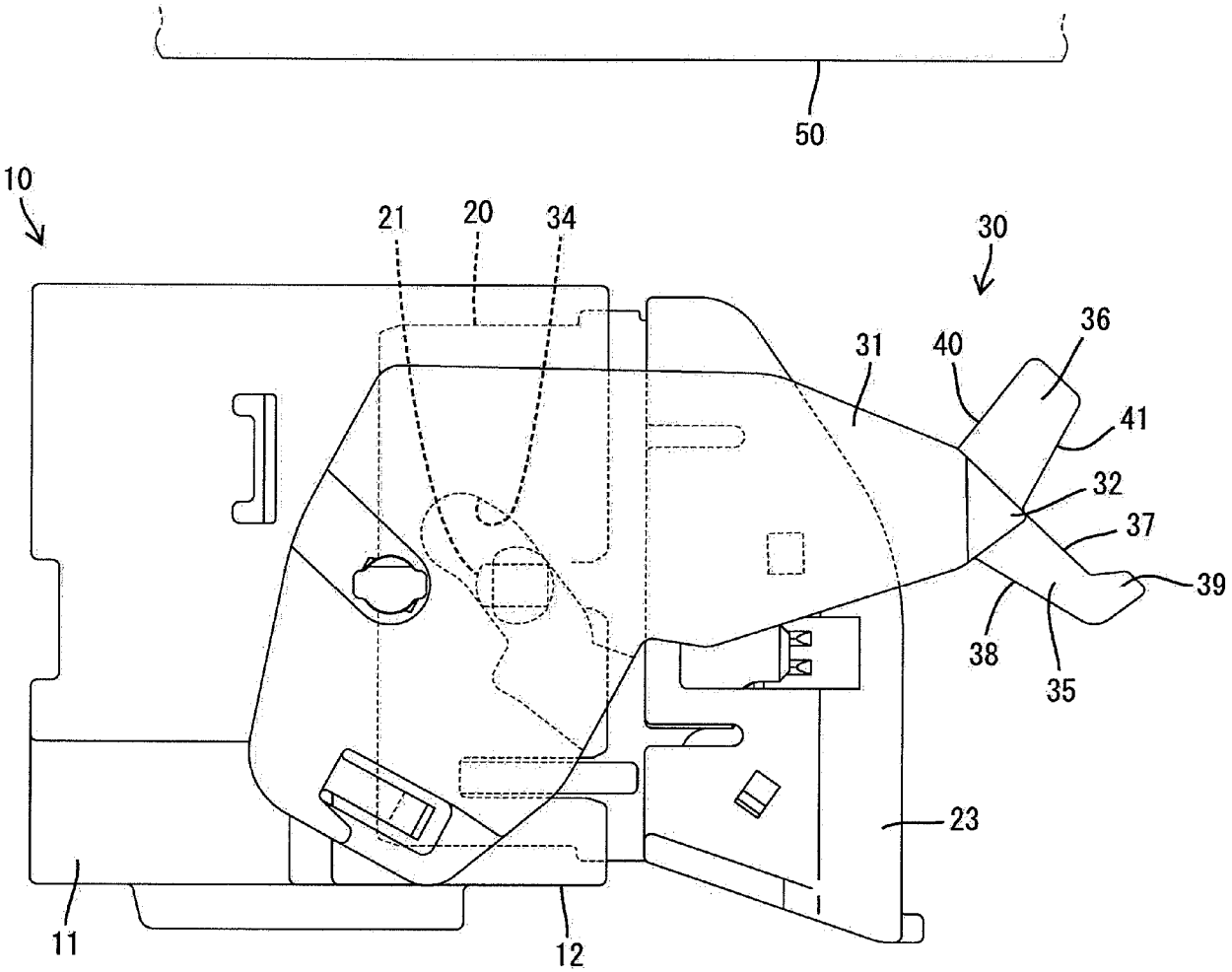
FIG. 3 is a side view showing a process in which the first and second housings are fitted together.

At the initial stage of fitting, rotation of the lever 30 begins by hooking a finger to the finger hook protrusion 39. Then, while the finger is being hooked to the finger hook protrusion 39, the first operating surface 37, used for fitting, is pressingly operated. Furthermore, as shown in FIG. 3, the lever 30 is rotated to a position in which a work space is secured between the second operation protrusion 36 and the other member 50, and a finger can be hooked to the second operation protrusion 36. Then, the finger is separated from the first operating surface 37, used for fitting, that finger presses down the second operating surface 40, used for fitting, and the rotation of the lever 30 advances. When the lever 30 reaches the fitting position, the fitting operation is complete.

Furthermore, if both the housings 10 and 20 are fitted together, for example, if the first operation protrusion 35 approaches another member (not shown), it may be difficult to hook a finger to the first operation protrusion 35. In this case, between the first operation protrusion 35 and the second operation protrusion 36, there is a space to which a finger can be hooked, so it is possible to pressingly operate the first operating surface 41 for separation with a finger. Thus, at the initial stage of the operation in which the two housings 10 and 20 are separated from each other, first, a finger presses down the first operating surface 41, used for separation, of the second operation protrusion 36, whereby the lever 30 is rotated to the initial position side. Then, as shown in FIG. 3, once the lever 30 is rotated to a position in which a finger can be hooked to the first operation protrusion 35, the finger is separated from the first operating surface 41, used for separation, and that finger presses down the second operating surface 38, used for separation, and the rotation of the lever 30 advances. If the lever 30 reaches the initial position, the rotation operation for separation is complete.

Furthermore, the first operating surface 41, used for separation, is held at a position and an orientation so as to be pressed down by a finger until the lever 30 reaches the initial position from the fitting position. Thus, at the time of separation, the lever 30 may be rotated by only pressing down the first operating surface 41 over the entire rotation area from the fitting position to the initial position, without having a finger switch from the first operation surface 41, used for separation, to the second operating surface 38, used for separation.

In this embodiment, a plurality of operation protrusions 35 and 36 are formed on the lever 30 and arranged at an interval in the direction in which the lever 30 is rotated to perform the fitting operation by contacting an operator's finger at the time of the fitting operation, and the separating operation by contacting an operator's finger at the time of the separating operation. Thus, if the housings 10 and 20 are fitted together or separated from each other, the lever 30 may be rotated in the fitting or separation direction while the plurality of operation protrusions 35 and 36 are passed from one hand to the other in order. If one operation protrusion 35 or 36 is rotatingly operated, an angle through which the operator's hand rotates is small, such that even though insufficient space is provided around the lever type connector for rotating the hand in the surroundings, rotation of the lever 30 can be operated without any problem or reduced problems, and operatability is enhanced or excellent.

Furthermore, the lever 30 includes: (i) a pair of arm portions 31, in which the cam grooves 34 are formed and which are arranged so as to be along the outside surface of the first housing 10, and (ii) the connecting portion 32 that connects the pair of arm portions 31. Additionally, the plurality of operation protrusions 35 and 36 protrude in a cantilever state from the connecting portion 32, and extend in a width direction connecting the pair of arm portions 31. According to this structure, the connecting portion 32 is reinforced by the operation protrusions 35 and 36, so improper deformation is reduced or not generated in the pair of arm portions 31. Thus, instability of engagement of the cam grooves 34 and the cam followers 21 due to improper deformation of the arm portions 31 can be reduced or suppressed.

Furthermore, from the connecting portion 32 of the lever 30, the plurality of operation protrusions 35 and 36 are protruded in a cantilever state in different directions from each other. The protruding directions of the plurality of operation protrusions 35 and 36 are directions diagonal to the rotating direction. According to this structure, only one connecting portion 32 is needed that connects the pair of arm portions 31, so in a process in which the lever 30 is rotated, the connecting portion 32 does not interfere with electric wires or the like that extend from the housings. Additionally, the protrusion directions of the plurality of fitting operation portions 35 and 36 are directions diagonal to the rotating direction, so the operating portions 35 and 36 sufficiently function as rotating operation means of the lever 30.

Additionally, if the first operation protrusion 35 receives a pressing force, in the rotating direction, by an operator's finger at the time of the fitting operation, the fitting operation portion protrudes in a direction such that the pressing force is away from the rotation center of the lever 30. Thus, the finger hook protrusion 39 is formed on the first operation protrusion 35, and protrudes in a direction substantially perpendicular to a direction in which the lever 30 is rotated. According to this structure, by applying a finger to the finger hook protrusion 39, the lever 30 can be reliably rotated in the fitting direction. Additionally, by arranging the finger hook protrusion 39 in the fitting operation portion 35, design restrictions at the time of designing the direction in which the fitting operation portion protrudes can be alleviated. Thus, a degree of freedom in design is large.

OTHER EMBODIMENTS

This invention is not limited to embodiments explained in the above-mentioned description and drawings, and at least the following other exemplary embodiments are also included within the technical scope of this invention.

(1) In the above-mentioned embodiments, two operation protrusions (fitting operating portions, separation operating portions) are arranged so as to be at an interval in the rotating direction, but the number of operation protrusions arranged so as to be at an interval in the rotating direction may also be three or more.

(2) In the above-mentioned embodiments, two operation protrusions protrude from one connecting portion. However, instead of this, one of the operation protrusions may protrude from the connecting portion, and another operation protrusion may protrude from another portion (another connecting portion) at an interval in the rotating direction with respect to the connecting portion.

(3) In the above-mentioned embodiments, the protruding directions of the operation protrusions are directions diagonal to the rotating direction, but the protruding directions of the operation protrusions may also be direction perpendicular to the rotating direction.

(4) In the above-mentioned embodiments, a finger hook protrusion was only formed on the first operating surface, used for engagement, but a finger hook protrusion may also be formed on the second operating surface, used for engagement, the first operating surface, used for separation, and the second operating surface, used for separation.

What is claimed is:

1. A lever type connector, comprising:

a first housing;

a lever that is rotatably fixed to the first housing, the lever defining a cam groove, a first fitting operation portion, and a second fitting operation portion, the first and second fitting operation portions being disposed to define an angle of approximately 120 degrees;

a finger hook protrusion disposed on the first fitting operation portion, the finger hook protrusion protruding in a direction of the second fitting operation portion; and a second housing having a cam follower;

wherein the first and second housings are fitted together by rotating the lever in a fitting direction in a state in which the cam groove and the cam follower are engaged to each other, and the fitting operation portions contact an operator's finger at a time of a fitting operation of the first housing to the second housing.

2. The lever type connector of claim 1, wherein the first housing defines a support shaft at each of two opposing exterior side surfaces, and the lever defines a bearing hole in each of two opposing arms, each support shaft extending into one of the bearing holes to rotatably couple the lever to the first housing.

3. The lever type connector of claim 1, wherein the second housing defines a pair of cam followers, and the lever defines a cam groove in each of two opposing arms, the cam followers engaging the cam grooves to bring the first and second housings together or move the first and second housing apart as the lever is rotated.

4. The lever type connector of claim 1, wherein the lever includes a connecting portion that connects two opposing arms, and the first and second fitting operation portions include a first operation protrusion and a second operation protrusion, respectively, formed on the connecting portion.

5. The lever type connector of claim 4, wherein the first operation protrusion defines two opposing operating surfaces, one of the surfaces contacting an operator's finger when the lever is rotated to move the first and second housings together, the other surface contacting the operator's finger when the lever is rotated to move the first and second housings apart.

6. The lever type connector of claim 5, wherein the second operation protrusion defines two opposing operation surfaces, one of the surfaces contacting an operator's finger when the lever is rotated to move the first and second housings together, the other surface contacting the operator's finger when the lever is rotated to move the first and second housings apart.

7. A lever type connector, comprising:

a first housing;

a moving plate in the first housing having a cam protrusion;

a lever that is rotatably fixed to the first housing, the lever defining a cam groove, a first fitting operation portion, and a second fitting operation portion;

a finger hook protrusion disposed on the first fitting operation portion, the finger hook protrusion protruding in a direction of the second fitting operation portion; and a second housing having a cam follower that engages the cam protrusion;

wherein the first and second housings are fitted together by rotating the lever in a fitting direction in a state in which the cam groove and the cam follower are engaged to each other, and the fitting operation portions contact an operator's finger at a time of a fitting operation of the first housing to the second housing.

8. The lever type connector of claim 7, wherein the first housing defines a support shaft at each of two opposing exterior side surfaces, and the lever defines a bearing hole in each of two opposing arms, each support shaft extending into one of the bearing holes to rotatably couple the lever to the first housing.

9. The lever type connector of claim 7, wherein the second housing defines a pair of cam followers, and the lever defines a cam groove in each of two opposing arms, the cam followers engaging the cam grooves to bring the first and second housings together or move the first and second housing apart as the lever is rotated.

10. The lever type connector of claim 7, wherein the lever includes a connecting portion that connects two opposing arms, and the first and second fitting operation portions include a first operation protrusion and a second operation protrusion, respectively, formed on the connecting portion.

11. The lever type connector of claim 10, wherein the first operation protrusion defines two opposing operating surfaces, one of the surfaces contacting an operator's finger when the lever is rotated to move the first and second housings together, the other surface contacting the operator's finger when the lever is rotated to move the first and second housings apart.

12. The lever type connector of claim 11, wherein the first and second operation protrusions are disposed to define an angle of approximately 120 degrees.

13. The lever type connector of claim 11, wherein the second operation protrusion defines two opposing operation surfaces, one of the surfaces contacting an operator's finger when the lever is rotated to move the first and second housings together, the other surface contacting the operator's finger when the lever is rotated to move the first and second housings apart.

* * * * *